United States Patent [19]

Winter, Jr. et al.

[11] Patent Number: 5,037,532

[45] Date of Patent: Aug. 6, 1991

[54] SLURRY HYDROTREATING PROCESS

[75] Inventors: William E. Winter, Jr., Baton Rouge, La.; Willard H. Sawyer, Dallas, Tex.

[73] Assignee: Exxon Research & Engineering Company, Florham Park, N.J.

[21] Appl. No.: 586,162

[22] Filed: Sep. 21, 1990

Related U.S. Application Data

[63] Continuation-in-part of Ser. No. 414,166, Sep. 28, 1989, abandoned.

[51] Int. Cl.[5] ..... C10G 45/04; C10G 45/46

[52] U.S. Cl. ..... 208/216 R; 208/254 H; 208/210; 208/143; 502/53

[58] Field of Search ..... 208/254 H, 210, 216 R, 208/143; 502/53

[56] References Cited

U.S. PATENT DOCUMENTS

| | | | |
|---|---|---|---|
| 2,700,015 | 1/1955 | Joyce, Jr. | 208/150 |
| 2,912,375 | 11/1959 | MacLaren | 208/149 |
| 3,254,021 | 5/1966 | Mason et al. | 208/53 |
| 3,297,563 | 1/1967 | Doumani | 208/110 |
| 3,531,398 | 9/1970 | Adams et al. | 208/216 R |
| 3,702,291 | 11/1972 | Jacquin et al. | 208/143 |
| 3,745,112 | 7/1973 | Rausch | 208/139 |
| 3,770,617 | 11/1973 | Riley et al. | 208/216 R |
| 3,841,996 | 10/1974 | Jacobson | 208/157 |
| 3,981,796 | 9/1976 | Hilfman | 208/254 |
| 4,108,761 | 8/1978 | Sze et al. | 208/254 H |
| 4,200,521 | 7/1980 | Stein et al. | 208/254 H |
| 4,431,526 | 2/1984 | Simpson et al. | 208/254 H |
| 4,557,821 | 12/1985 | Lopez et al. | 208/216 R |
| 4,610,779 | 9/1986 | Markley et al. | 208/53 |
| 4,619,759 | 11/1986 | Myers et al. | 208/254 H |
| 4,786,402 | 11/1988 | Anstock et al. | 208/143 |
| 4,849,093 | 7/1984 | Vauk et al. | 208/143 |
| 4,952,306 | 8/1990 | Sawyer et al. | 208/216 R |

*Primary Examiner*—Helane E. Myers

*Attorney, Agent, or Firm*—Roy J. Ott

[57] ABSTRACT

A slurry hydrotreating process is described in which a hydrotreating catalyst of small particle size is contacted with a heavy fossil fuel. High catalyst activity is maintained by circulating the catalyst between a hydrotreating zone and a reactivating zone where the catalyst is hydrogen stripped.

22 Claims, 1 Drawing Sheet

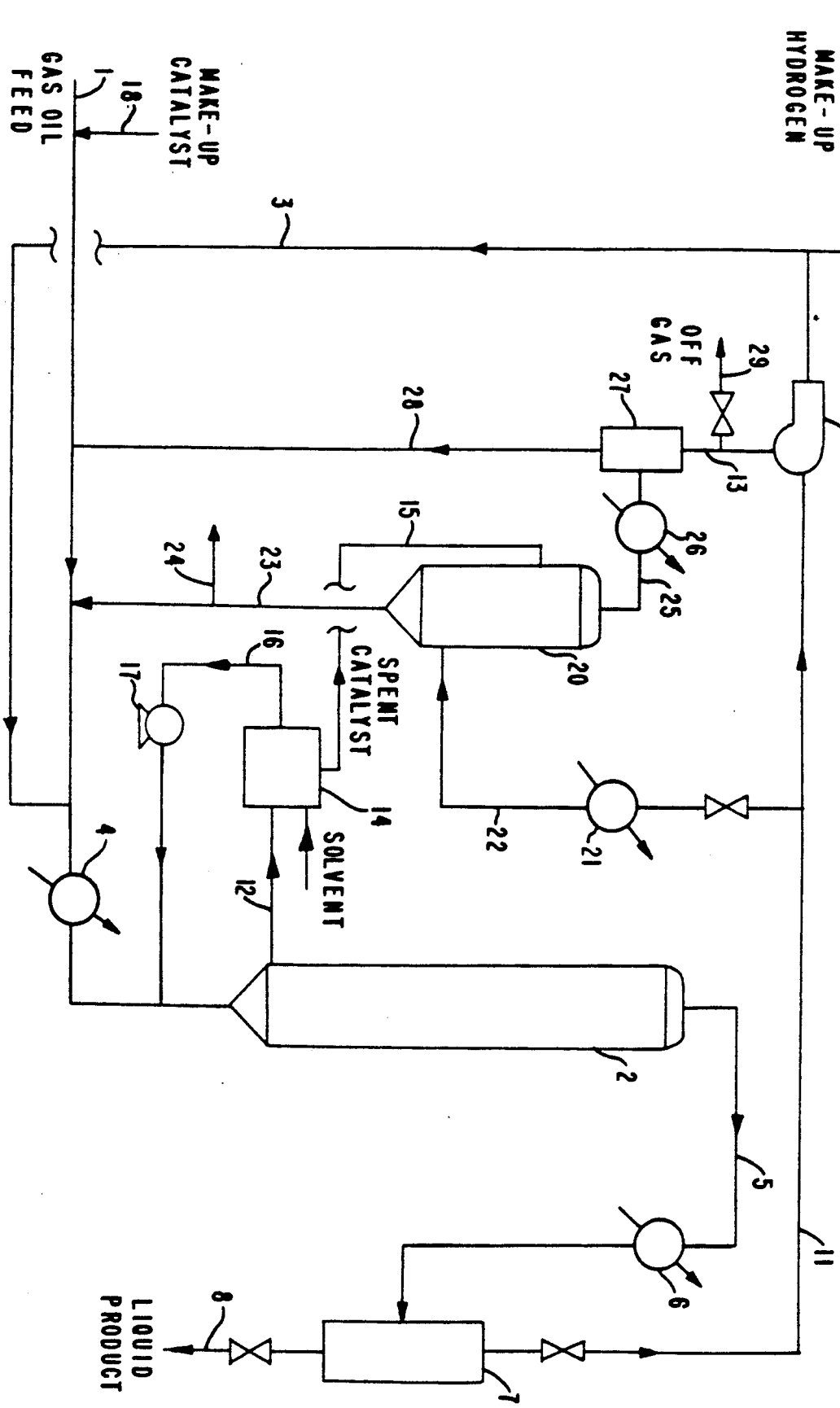
MAKE-UP HYDROGEN
30
10
11
OFF GAS
29
13
27
26
25
28
3
MAKE-UP CATALYST
18
GAS OIL FEED
1
15
20
24
23
SPENT CATALYST
16
17
14
SOLVENT
12
22
21
4
2
5
6
7
8
LIQUID PRODUCT

SLURRY HYDROTREATING PROCESS

CROSS REFERENCE TO RELATED APPLICATIONS

This application is a continuation-in-part application of application Ser. No. 414,166, filed Sept. 28, 1989 now abandoned.

BACKGROUND OF THE INVENTION

This invention relates to the use of a catalyst slurry for hydrotreating heavy fossil fuel feedstocks such as vacuum gas oils or heavy gas oils. High catalyst activity is maintained by circulating the catalyst between a hydrotreating zone and a hydrogen stripping reactivation zone.

The petroleum industry employs hydrotreating to process heavy vacuum gas oils, particularly coker gas oils, in order to improve their quality as fluid catalytic cracker (FCC) feeds. Hydrotreating accomplishes the saturation of multi-ring aromatic compounds to one-ring aromatics or completely saturated naphthenes. This is necessary to assure low coke and high gasoline yields in the cat cracker. Multi-ring aromatics cannot be cracked effectively to mogas and heating oil products, whereas partially hydrogenated aromatics or naphthenes can be cracked to premium products. Hydrotreating is further capable of removing sulfur and nitrogen which is detrimental to the cracking process.

Hydrotreating employs catalysts that tend to become poisoned by organic nitrogen compounds in the feed. Such compounds become adsorbed onto the catalyst and tie up needed hydrogenation sites due to the slow kinetics or turnover for hydrodenitrogenation. Higher temperatures may be utilized to overcome this problem. However, at high temperatures thermodynamic equilibrium tends to favor the preservation of undesirable multi-ring aromatic compounds.

It is an object of the present invention to circumvent both the kinetic and equilibrium limits encountered in conventional hydrotreating processes which employ fixed bed catalysts. It is a further object of the present invention to provide an improved hydrotreating process employing a catalyst slurry. It is a still further object of the present invention to accomplish reactivation of the catalyst employed in the present process by hydrogen stripping the catalyst in an essentially continuous cyclic process.

In comparison to the present process, hydrogen stripping with a conventional fixed bed reactor has been found to provide only a temporary gain in catalyst activity, which gain is quickly lost in a few days. Therefore, frequent and expensive shut downs would be required for hydrogen stripping to be effective in a fixed bed hydrotreating process.

Hydrotreating processes utilizing a slurry of dispersed catalysts in admixture with a hydrocarbon oil are generally known. For example, Pat. No. 4,557,821 to Lopez et al discloses hydrotreating a heavy oil employing a circulating slurry catalyst. Other patents disclosing slurry hydrotreating include U.S. Pat. Nos. 3,297,563; 2,912,375; and 2,700,015.

Various problems in operating the slurry processes disclosed in the prior art have apparently hindered commercialization. For example, according to the process disclosed in Pat. Nos. 4,557,821; 2,912,375 and 2,700,015, it is necessary to reactivate the catalyst by air oxidation. However, air oxidation is expensive since depressurization of the catalyst environment between the hydrotreating reactor and the reactivator, requiring expensive lock hoppers, is necessary before combusting off the contaminants on the catalyst. Furthermore, expensive equipment is necessary to avoid air contamination and possible explosions.

BRIEF DESCRIPTION OF THE INVENTION

The present invention is directed to a method of maintaining high catalyst activity in a slurry hydrotreating process for heavy fossil fuels wherein a hydrotreating catalyst of small particle size is contacted with heavy petroleum or synfuel stocks for hydrogenation of heavy aromatics and removal of nitrogen and sulfur. The catalyst is circulated between a hydrotreating reaction zone and hydrogen stripping reactivation zone.

These and other objects are accomplished according to our invention, which comprises a slurry hydrotreating process for hydrotreating a heavy fuel to hydrogenate heavy aromatics and remove sulfur, the process comprising:

(1) reacting the heavy fuel in a hydrotreating zone with hydrogen in the presence of a non-noble metal containing hydrotreating catalyst;

(2) separating the catalyst from the product of the hydrotreating zone;

(3) reactivating the catalyst in a reactivation zone, separate from the hydrotreating zone, by subjecting the same to hydrogen stripping; and (4) recycling the reactivated catalyst to the hydrotreating zone.

BRIEF DESCRIPTION OF THE DRAWINGS

The process of the invention will be more clearly understood upon reference to the detailed discussion below upon reference to FIG. 1 (Sole Fig.) which shows a schematic diagram of one process scheme according to this invention comprising a slurry hydrotreating step and hydrogen reactivation stripping step.

DETAILED DESCRIPTION OF THE INVENTION

Applicants' process is directed to a slurry hydrotreating process in which the catalyst used in a hydrotreating zone is reactivated by hydrogen stripping in a cyclic, preferably continuous process.

The catalyst is reactivated in a separate reactivation zone and recycled back to the hydrotreating zone. In addition, fresh or reactivated (regenerated) catalyst can be continually added while aged or deactivated catalyst can be purged or reactivated. Because the catalyst is being regularly reactivated according the present process, the slurry hydrotreating step can be operated at more severe conditions (which otherwise tend to deactivate the catalyst) than used in conventional fixed bed hydrotreating. Thus, the process of the invention can be operated at a lower pressure for a given temperature or at a higher temperature for a given pressure. A conventional fixed bed hydrotreater typically operates for about 1 or 2 years before it is necessary to shut it down in order to replace the catalyst. An advantage of the present slurry process in combination with catalyst reactivation is increased activity of the catalyst compared to a fixed bed.

It is noted that the permanent deactivation of the catalyst which occurs in conventional fixed bed hydrotreating is reduced in the present hydrotreating process by hydrogen reactivation. This permanent deactivation is believed to occur by the presence of coking, resulting from polymerization reactions and metal deactivation, caused by the presence of organic metal compounds present in the feedstocks. These polymerization reactions are prevented by periodic hydrogen reactivation which strips adsorbed feed from the catalyst.

As mentioned, the slurry hydrotreating step can be operated at more severe conditions than used in conventional fixed bed hydrotreating. A fixed bed hydrotreater operating with VGO type feeds typically operates at a start of run temperature of about 700° F. or less. The slurry hydrotreater of the invention would typically operate, for example, at about 740° F. The higher operation temperature would boost reaction rates by a factor of 2 or more over the fixed bed unit. Reactivating the catalyst would provide further reaction rate advantages.

The slurry hydrotreating process of this invention can be used to treat various feeds including fossil fuels such as heavy catalytic cracking cycle oils (HCCO), coker gas oils, and vacuum gas oils (VGO) which contain significant concentrations of multi-ring and polar aromatics, particularly large asphaltenic molecules. Similar gas oils derived from petroleum, coal, bitumen, tar sands, or shale oil are suitable feeds.

Suitable feeds for processing according to the present invention include those gas oil fractions which are distilled in the range of 500° to 1200° F., preferably in the 650° to 1100° F. range. Above 1200° F. it is difficult or impossible to strip all of the feed off the catalyst with hydrogen and the catalyst tends to coke up. Also, the presence of concarbon and asphaltenes deactivate the catalyst. The feed should not be such that more than 10% boils above 1050° F. The nitrogen content is normally greater than 1500 ppm. The sulfur content, particularly for VGO feeds will typically contain at least 0.1 wt.% sulfur, more typically at least 1.0 wt.%. The 3+ring aromatics content of the feed will generally represent 25% or more by weight. Polar aromatics are generally 5% or more by weight and concarbon constitutes 1% or more by weight.

Suitable catalysts for use in the present process include non-noble Group VIB, VIIB and VIII Group metals such as those well known in the art. These include, but are not limited to, molybdenum (Mo) sulfides, mixtures of transition metal sulfides such as Ni, Mo, Co, Fe, W, Mn, and the like. Typical catalysts include NiMo, CoMo, or CoNiMo combinations. In general sulfides of Group VII metals are suitable. (The Periodic Table of Elements referred to herein is given in *Handbook of Chemistry and Physics,* published by the Chemical Rubber Publishing Company, Cleveland, Ohio, 45th Edition, 1964.) These catalyst materials can be unsupported or supported on inorganic oxides such as alumina, silica, titania, silica alumina, silica magnesia and mixtures thereof. Zeolites such as USY or acid micro supports such as aluminated CAB-0-SIL can be suitably composited with these supports. Catalysts formed in-situ from soluble precursors such as Ni and Mo naphthenate or salts of phosphomolybdic acids are suitable.

In general the catalyst material may range in diameter from 1 μto ⅛inch. Preferably, the catalyst particles are 1 to 400 μin diameter so that intra particle diffusion limitations are minimized or eliminated during hydrotreating.

In supported catalysts, transition metals such as Mo are suitably present at a weight percent of 5 to 30%, preferably 10 to 20%. Promoter metals such as Ni and/or Co are typically present in the amount of 1 to 15%. The surface area is suitably about 80 to 400 $m^2/g$, preferably 150 to 300 $m^2/g$.

Methods of preparing the catalyst are well known. Typically, the alumina support is formed by precipitating alumina in hydrous form from a mixture of acidic reagents in an alkaline aqueous aluminate solution. A slurry is formed upon precipitation of the hydrous alumina. This slurry is concentrated and generally spray dried to provide a catalyst support or carrier. The carrier is then impregnated with catalytic metals and subsequently calcined. For example, suitable reagents and conditions for preparing the support are disclosed in U.S. Pat. Nos. 3,770,617 and 3,531,398, herein incorporated by reference. To prepare catalysts up to 200 microns in average diameter, spray drying is generally the preferred method of obtaining the final form of the catalyst particle. To prepare larger size catalysts, for example about 1/32 to ⅛ inch in average diameter, extruding is commonly used to form the catalyst. To produce catalyst particles in the range of 200 μ to 1/32 inch, the oil drop method is preferred. The well known oil drop method comprises forming an alumina hydrosol by any of the teachings taught in the prior art, for example by reacting aluminum with hydrochloric acid, combining the hydrosol with a suitable gelling agent and dropping the resultant mixture into an oil bath until hydrogel spheres are formed. The spheres are then continuously withdrawn from the oil bath, washed, dried, and calcined. This treatment converts the alumina hydrogel to corresponding crystalline gamma alumina particles. They are then impregnated with catalytic metals as with spray dried particles. See for example, U.S. Pat. Nos. 3,745,112 and 2,620,314.

Referring to FIG. 1, a feed stream 1, consisting for example of gas oil feed, is introduced into a slurry hydrotreating reactor 2. Before being passed to this reactor, the feedstream is typically mixed with a hydrogen containing gas in stream 3 and heated to a reaction temperature in a furnace or preheater 4. A make-up hydrogen stream 30 may be introduced into the hydrogen stream 3, which in turn may be either combined with the feed stream or alternatively mixed in the hydrotreating reactor 2. The hydrotreating reactor contains a catalyst in the form of a slurry at a solids weight percent of about 10 to 70 percent, preferably 40 to 60 percent. In the embodiment shown in the figure, the feed enters through the bottom of the reactor and bubbles up through an ebulating or fluidized bed.

Depending on the size of the catalyst particles, the hydrotreating reactor may have filters at the entrance and/or exit orifices to keep the catalyst particles in the reactor. Alternatively, the reactor may have a flare (increasing diameter) configuration such that when the reactor is kept at minimum fluidization velocity, the catalyst particles are prevented from escaping through an upper exit orifice.

Although a single slurry hydrotreating reactor may be used in the present process, it is preferred for greater efficiencies that the slurry hydrotreating process be operated in two or more stages, as disclosed in copending U.S. Application No. 414,175, hereby incorporated by reference. Accordingly, a high temperature stage may be followed by one or more low temperature stages. For example, a two stage process might process fresh feed in a 760° F. stage and process the product from the first stage in a 720° F. stage. Alternatively, several stages can be operated at successively lower temperatures, such as a 780° F. stage followed by a 740° F. stage followed by a 700° F. stage. Such an arrangement provides fast reaction rates in the first stage and lower equilibrium multi-ring aromatics levels (hence greater kinetic driving forces) in the final stage or stages. Staging is especially advantageous in the present slurry process as compared to a fixed bed process because the initial stages can be operated at higher temperatures, heat transfer is better and diffusion does not limit reaction rates.

Referring again to FIG. 1, an effluent from the hydrotreating reactor 2, containing liquids and gases and substantially no catalyst solids, is passed via stream 5 through a cooler 6 and introduced into a gas-liquid separator or disengaging means 7 where the hydrogen gas along with ammonia and hydrogen sulfide by-products from the hydrotreating reactions may be separated from the liquid product in stream 8. The separated gases in stream 11 are recycled via compressor 10 back for reuse in the hydrogen stream 3. The recycled gas is usually passed through a scrubber to remove hydrogen sulfide and ammonia because of their inhibiting effects on the kinetics of hydrotreating and also to reduce corrosion in the recycle circuit.

In many cases, the liquid product in stream 8 is given a light caustic wash to assure complete removal of hydrogen sulfide. Small quantities of hydrogen sulfide, if left in the product, will oxidize to free sulfur upon exposure to the air, and may cause the product to exceed pollution or corrosion specifications.

In order to reactivate the catalyst in the hydrotreating reactor 2, an exit stream containing catalyst solids is removed from the reactor as stream 12 and enters a separator 14, which may be a filter, vacuum flash, centrifuge, or the like to divide the effluent into a catalyst stream 15 and a liquid stream 16 for recycle via pump 17 to the hydrotreating reactor 2.

The catalyst stream 15 from separator 14 comprises suitably 30 to 60 percent catalyst. Optionally this catalyst stream may be diluted with a lighter liquid such as naphtha to fluidize the catalyst and aid in the transport of the catalyst, while permitting easy separation by distillation and recycle. In any case, the catalyst material is transported to the stripper reactor or reactivator 20. A hydrogen stream 22, preferably heated in heater 21, is introduced into reactivator 20 where the catalyst is hydrogen stripped. The reactivator yields a reactivated catalyst stream 23 for recycle back to the hydrotreating reactor 2. Spent catalyst may be purged from stream 23 via line 24 and fresh make-up catalyst introduced via line 18 into the feed stream. The reactivated catalyst from the reactivator 20 is suitably returned to the hydrotreating reactor 2 at a rate of about 0.05 to 0.50 lbs reactivated catalyst to lbs gas oil feed, preferably 0.1 to 0.3.

The reactivator 20 also yields a top gas stream 25 which is subsequently passed through cooler 26, gas-liquid separator 27 and via stream 13 combined with the hydrogen recycle stream 11. Off gas may be purged via line 29. Stripped liquids from the separator 27 may be returned to the hydrotreater reactor 2 via stream 28.

The process conditions in the process depend to some extent on the particular feed being treated. The hydrotreating zone of the reactor is suitably at a temperature of about 650° to 780° F., preferably 675° to 750° F. and at a pressure of 800 to 4000 psig, preferably 1500 to 2500 psig. The hydrogen treat gas rate is 1500 to 10,000 SCF/B, preferably 2500 to 5000 SCF/B. The space velocity or holding time (WHSV, lb/lb of catalyst-hr) is suitably 0.2 to 5.0, preferably 0.5 to 2.0.

The reactivating zone is suitably maintained at a temperature of about 650° to 780° F., preferably 675° to 750° F., and a pressure of about 800 to 4000 psig, preferably 1500 to 2500. The strip rate (SCF, lb catalyst-hr) is suitably about 0.03 to 7, preferably 0.15 to 1.5.

EXAMPLE 1

To illustrate a slurry hydrotreating process, according to the first step of the present invention, the following experiment was conducted. A commercial hydrotreating catalyst, KF-840, was crushed and screened to 32/42 mesh size. Catalyst properties are shown in Table I. This crushed catalyst was then sulfided overnight using a 10% $H_2S$ in $H_2$ gas blend. A 10.3 gram sample of the presulfided catalyst was added to a 300 cc stirred autoclave reactor along with 100 cc's of a heavy feed blend comprised of heavy vacuum gas oils, heavy coker gas oils, coker bottoms and heavy cat cracked cycle oil. Properties of the feed are listed in Table II.

TABLE I

| Catalyst Properties | |
|---|---|
| NiO, Wt % | 3.8 |
| MoO3, Wt % | 19.1 |
| $P_2O_5$, Wt % | 6.4 |
| Surface Area, $m^2$/gm | 175 |
| Pore/volume, $cm^3$/gm | 0.38 |

TABLE II

| Feedstock Properties | |
|---|---|
| Sulfur, Wt % | 1.63 |
| Nitrogen, Wt % | 0.39 |
| Carbon, Wt % | 87.63 |
| Hydrogen, Wt % | 9.60 |
| Gravity, °API | 9.2 |
| Wt % Aromatics by HPLC | |
| Saturates | 26 |
| 1 Ring | 9 |
| 2 Ring | 10 |
| 3+ Ring | 43 |
| Polar Aromatics | 12 |
| GC Distillation, °F. | |
| 5% | 665 |
| 20% | 753 |
| 50% | 882 |
| 80% | 1004 |
| 95% | 1150 |

The autoclave was heated to 720° F. under 1200 psig hydrogen pressure. The autoclave was operated in a gas flow thru mode so that hydrogen treat gas was added continuously while gaseous products were taken off. Hydrogen was added over the course of the run so that the initial hydrogen charge plus make-up hydrogen was equivalent to 3500 SCF/B of liquid charged to the autoclave. After two hours at reaction conditions, the autoclave was quenched or cooled quickly to stop reactions. The autoclave reactor was de-pressured and the catalyst was filtered from the liquid products. These products were then analyzed to determine the extent of HDS (hydrodesulfurization), HDN (hydrodenitrogenation), and aromatics hydrogenation. The results are shown in Table III below.

In another run, at a higher catalyst loading, a 30.9 gram of the same presulfided catalyst was added to a 300 cc sample stirred autoclave reactor along with 100 cc's of the same heavy feed blend. The autoclave was run as the same conditions as in the previous experiment. The results of this run are also shown in Table III.

TABLE III

| Slurry Catalyst Loading and Product Quality | Feed Properties | Fresh, Sulfided Catalyst | Fresh, Sulfided Catalyst |
|---|---|---|---|
| Slurry Catalyst Loading Wt % Catalyst on FF. | 0 | 10.5 | 31.5 |
| Slurry Product Quality | | | |
| Wt % Sulfur | 1.63 | 0.32 | 0.10 |
| Wt % Nitrogen | 0.39 | 0.22 | 0.093 |
| Wt % Sats + 1R AR | 34 | 55 | 66 |
| Wt % 3+ R AR & Polars | 55 | 28 | 18 |
| Wt % Polar AR | 12 | 4.1 | 1.2 |

From these results, it can be concluded that the fresh catalyst slurry was very effective for removing organic sulfur and organic nitrogen compounds from the heavy feed blend. With only 10% catalyst on fresh feed (FF), only 20% of the organic sulfur, 55% of the organic nitrogen, and half the 3+ ring aromatics contained in the raw feed remained. Only a third of the heaviest, polar aromatic compounds remained. With a higher catalyst loading, 31% on fresh feed, even higher levels of contaminant removal were obtained. Only 6% of the organic sulfur, a fourth of the organic nitrogen, and a third of the heavy aromatics remained. Polar aromatics were reduced to 10% of the feed value.

EXAMPLE 2

To illustrate the second step of the invention, involving hydrogen catalyst reactivation, the following experiment was conducted. Catalyst discharged from an autoclave experiment at the same conditions of the first two runs of Example 1 was stripped with an $H_2S/H_2$ blend for 18 hours at 650° F. After hydrogen stripping, the catalyst discharged from the first autoclave pass was laden with 3.6% "coke" or adsorbed hydrocarbons. A 32.0 gm sample of this coke laden catalyst, containing 30.9 gms of the NiMo/alumina catalyst was charged to a 300 cc autoclave with 100 cc's of the same feed used in Experiment 1. The autoclave was run at the same conditions as Experiment 1. The catalyst was filtered from the products and hydrogen stripped again for use in a subsequent run. This procedure was repeated until the product analyses had leveled off. Product analyses are shown in Table IV.

Catalyst discharged from an autoclave run at the same conditions as in Experiment 1 was filtered and charged to the autoclave with the same feed as the previous runs. The same filtered catalyst was recycled in the autoclave several times in order to line out catalyst performance. The results of these runs are shown below.

TABLE IV

| Slurry Catalyst Loading and Product Quality | Recycled, Hydrogen Stripped Catalyst | Recycled, Filtered Catalyst |
|---|---|---|
| Slurry Catalyst Loading Wt % Catalyst on FF | 31.5 | 31.5 |
| Slurry Product Quality | | |
| Wt % Sulfur | 0.10 | 0.12 |
| Wt % Nitrogen | 0.093 | 0.18 |
| Wt % Sats + 1R AR | 64 | 61 |
| Wt % 3+ R AR & Polars | 18 | 23 |

TABLE IV-continued

| Slurry Catalyst Loading and Product Quality | Recycled, Hydrogen Stripped Catalyst | Recycled, Filtered Catalyst |
|---|---|---|
| Wt % Polar AR | 1.2 | 2.7 |

From the above results, it can be concluded that the recycled catalyst was still highly active for nitrogen and sulfur removal, as well as aromatics hydrogenation. Although, catalyst activity for HDN and heavy aromatics removal were diminished somewhat, hydrogen stripping restored catalyst to nearly fresh activity.

EXAMPLE 3

To further illustrate a hydrogen stripping catalyst reactivation process, the following experiment was conducted. Another lot of the same commercial catalyst used in the previous experiments was used in a fixed bed reactor for several hundred hours on oil. Prior to discharging, the catalyst was stripped with hydrogen at 700° F. for several hours. After the catalyst was discharged from a fixed bed reactor, a portion of it was crushed and screened to 32/42 mesh size. This catalyst was ladened with 21.2% coke or adsorbed hydrocarbons. A 39.2 gram sample of this coked catalyst, containing 30.9 grams of NiMo/alumina catalyst, was charged to the autoclave with the same feed as the previous examples. The catalyst was filtered from the products and recycled in an autoclave run several times in order to line-out catalyst performance. The results of these runs with the hydrogen stripped, aged catalyst and the filtered, aged catalyst are shown in Table IV.

TABLE IV

| Slurry Catalyst Loading and Product Quality | Hydrogen Stripped, Aged Catalyst | Recycled, Filtered, Aged Catalyst |
|---|---|---|
| Slurry Catalyst Loading Wt % Catalyst on FF | 31.5 | 31.5 |
| Slurry Product Quality | | |
| Wt % Sulfur | 0.20 | 0.25 |
| Wt % Nitrogen | 0.14 | 0.27 |
| Wt % Sats + 1R AR | 62 | 56 |
| Wt % 3+ R AR & Polars | 25 | 29 |
| Wt % Polar AR | 3.6 | 5.2 |

From the above results, it can be concluded that although the hydrogen stripped catalyst was less active than fresh, it was substantially more active than the catalyst which was recycled without hydrogen stripping. On the other hand, without hydrogen stripping, the aged catalyst lost much of its activity.

The process of the invention has been described generally and by way of example with reference to particular embodiments for purposes of clarity and illustration only. It will be apparent to those skilled in the art from the foregoing that various modifications of the process illustrated herein can be made without departure from the spirit and scope of the invention.

What is claimed is:

1. A slurry hydrotreating process for hydrotreating a heavy fossil fuel to hydrogenate heavy aromatics and remove sulfur, the process comprising:

reacting the heavy fossil fuel in a hydrotreating zone with hydrogen in the presence of a non-noble metal containing hydrotreating catalyst;

separating the catalyst from the product of the hydrotreating zone;

reactivating the catalyst in a reactivating zone, separate from the hydrotreating zone, by hydrogen stripping; and recycling the reactivated catalyst to the hydrotreating zone.

2. The process of claim 1 wherein the hydrotreating zone contains the hydrotreating catalyst in the form of a slurry at a solids weight percent in the range of about 10 to 70 percent.

3. The process of claim 2, wherein the reactivating zone is at a temperature of about 650 to 780° F. and a pressure of about 800 to 4000 psig.

4. The process of claim 3, wherein the hydrotreating zone is at a temperature of about 650° to 780° F. and a pressure of about 800 to 4000 psig.

5. The process of claim 4 wherein the hydrotreating catalyst slurry contains 40 to 60 weight percent solids.

6. The process of claim 2, wherein the heavy fossil fuel is a product of a petroleum, coal, shale oil, bitumen, tar sand, or synfuel conversion process.

7. The process of claim 6, wherein the heavy fossil fuel is a heavy catalytic cracking cycle oil, coker gas oil, or vacuum gas oil.

8. The process of claim 7 wherein the heavy fossil fuel is a vacuum gas oil containing at least 0.1 wt% sulfur.

9. The process of claim 8 wherein the vacuum gas oil contains at least 1.0 wt.% sulfur.

10. The process of claim 7, wherein the heavy fossil fuel is distilled in the range of 500 to 1200° F.

11. The process of claim 1, comprising a plurality of staged hydrotreating zones.

12. The process of claim wherein the catalyst is comprised of molybdenum sulfide.

13. The process of claim 12, wherein the catalyst further comprises nickel and/or cobalt.

14. The process of claim 13, wherein the catalyst is supported on an inorganic oxide material.

15. The process of claim 14, wherein the inorganic oxide material is selected from group consisting of alumina, silica, titania, silica alumina, silica magnesis, and mixtures thereof.

16. The process of claim 2, wherein the catalyst is 10 $\mu$ to $\frac{1}{8}$ inch in average diameter.

17. The process of claim 16, wherein the catalyst is 10 $\mu$ to 400 $\mu$ in average diameter.

18. The process of claim 17, wherein the surface area of the catalyst is 80 to 400 $m^2/g$.

19. The process of claim 2, wherein the pressure in the reactivating zone is 1500 to 2500 psig.

20. The process of claim 19, wherein the stripping rate is 0.15 to 7 SCF/lb cat-hr.

21. The process of claim 20, wherein catalyst is circulated at a rate of 0.1 to 0.3 lbs of reactivated catalyst per pound of feed.

22. A slurry hydrotreating process for hydrotreating a heavy fossil fuel to hydrogenate heavy aromatics and remove sulfur, the process comprising:

reacting the heavy fossil fuel in a hydrotreating zone with hydrogen in the presence of a non-noble metal containing hydrotreating catalyst wherein the catalyst is in the form of a slurry at a solids weight percent in the range of about 10 to 70 weight percent;

separating the catalyst from the product of the hydrotreating zone;

reactivating the catalyst in a reactivating zone, separate from the hydrotreating zone, at a temperature of between about 650° to 780° F. and a pressure of between about 800 to 4000 psig with hydrogen at a stripping rate of 0.15 to 7 SCF/lb cat-hr; and recycling the reactivated catalyst at a rate of 0.1 to 0.3 lbs of reactivated catalyst per pound of feed to the hydrotreating zone.

* * * * *